US007370931B2

(12) United States Patent
Nunokawa

(10) Patent No.: US 7,370,931 B2
(45) Date of Patent: May 13, 2008

(54) LIQUID EJECTING APPARATUS, LIQUID EJECTING METHOD, AND LIQUID EJECTING SYSTEM

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 104 days.

(21) Appl. No.: 10/540,140

(22) PCT Filed: Jan. 28, 2004

(86) PCT No.: PCT/JP2004/000728

§ 371 (c)(1),
(2), (4) Date: Jun. 21, 2005

(87) PCT Pub. No.: WO2004/071774

PCT Pub. Date: Aug. 26, 2004

(65) Prior Publication Data

US 2006/0125862 A1 Jun. 15, 2006

(30) Foreign Application Priority Data

Feb. 14, 2003 (JP) ..... 2003-036987

(51) Int. Cl.
*B41J 29/393* (2006.01)

(52) U.S. Cl. ..... 347/19; 347/36; 347/9; 347/15

(58) Field of Classification Search ..... 347/5, 347/7, 9, 19, 23, 36, 15, 30
See application file for complete search history.

(56) References Cited

U.S. PATENT DOCUMENTS

| | | | |
|---|---|---|---|
| 6,612,691 | B1 | 9/2003 | Koitabashi et al. |
| 6,752,494 | B2 | 6/2004 | Matsui |
| 6,890,069 | B2 | 5/2005 | Matsui |
| 6,991,327 | B2 | 1/2006 | Goto et al. |

FOREIGN PATENT DOCUMENTS

| | | | |
|---|---|---|---|
| CN | 1388001 | A | 1/2003 |
| JP | 10-195404 | A | 7/1998 |
| JP | 11-129460 | A | 5/1999 |
| JP | 2001-322346 | A | 11/2001 |
| JP | 2002-326345 | A | 11/2002 |
| JP | 2003-25563 | A | 1/2003 |

*Primary Examiner*—Lamson Nguyen
(74) *Attorney, Agent, or Firm*—Sughrue Mion, PLLC

(57) ABSTRACT

A liquid ejecting apparatus is provided with a liquid ejecting section that ejects a plurality of types of liquid toward a medium, wherein among the liquids that are ejected from the liquid ejecting section and that reach a region that is outside the medium, an ejection amount of some types of the liquid is reduced.

7 Claims, 15 Drawing Sheets

LIQUID EJECTING APPARATUS, LIQUID EJECTING METHOD, AND LIQUID EJECTING SYSTEM

TECHNICAL FIELD

The present invention relates to liquid ejecting apparatuses such as inkjet printers that eject liquid onto a medium, liquid ejecting methods, and liquid ejecting systems.

BACKGROUND ART

Inkjet printers are known as one type of liquid ejecting apparatus that ejects liquid toward a medium. The inkjet printer is configured so as to perform printing by ejecting ink, as the liquid, onto a medium such as paper. Recent-type inkjet printers are provided with a print function known as "borderless printing". "Borderless printing" refers to a printing method in which ink is applied up to the very edge of the medium to perform printing such that no blank space is formed on the medium. The ink that is ejected up to the very edge of the medium may miss the medium due to positional misalignment of the medium, for example. Thus, such printers are provided with a recovery section for recovering the ink that has been discarded. The recovery section may, for example, be provided with an absorbing material that is configured so as to absorb the ink that has missed the medium, such as a sponge, and the ink that is recovered is absorbed by the absorbing material and held therein.

However, such "borderless" printing has the following problems: among the inks that are ejected, there are types that have low permeability or that easily solidify, for example. When such ink misses the medium during "borderless" printing and reaches the top of the absorbing material of the ink recovery part, there is a possibility that the ink will not easily permeate into the absorbing material but instead remain as it is on the surface. In such a case, if ink is subsequently discarded on top of the remaining ink and remains thereon without readily permeating, the problem of a continuing accumulation of ink on the absorbing material arises. When ink accumulates and is piled up in this manner, discarded ink sequentially piles up on the absorbing material, and may eventually cause problems such as soiling of the printing medium and adversely affecting the movement of the head. Particularly, in recent years, printing technology has been proposed that uses special reacting liquids to accelerate coagulation of the ink to improve color saturation in order to achieve increased image quality. If such reacting liquids are used, then coagulation of the ink continues, and the accumulation amount may further increase. This has been a problem.

The present invention has been made in light of the foregoing issues, and it is an object thereof to reduce the occurrence of problems such as build up of liquid such as ink that has reached a region outside the medium during, for example, "borderless printing".

DISCLOSURE OF INVENTION

A principal aspect of the invention for achieving the foregoing object is a liquid ejecting apparatus comprising: liquid ejecting means that ejects a plurality of types of liquid toward a medium; and ejection control means that controls ejection of the liquid from the liquid ejecting means; wherein when the liquid ejecting means attempts to eject the liquid into a region that is outside the medium, the ejection control means prevents one or more types of liquid, of among the plurality of types of liquid, from being ejected into the region that is determined to be outside the medium.

Other features of the present invention will become clear through the present specification and descriptions in the accompanying drawings.

Figure 1:
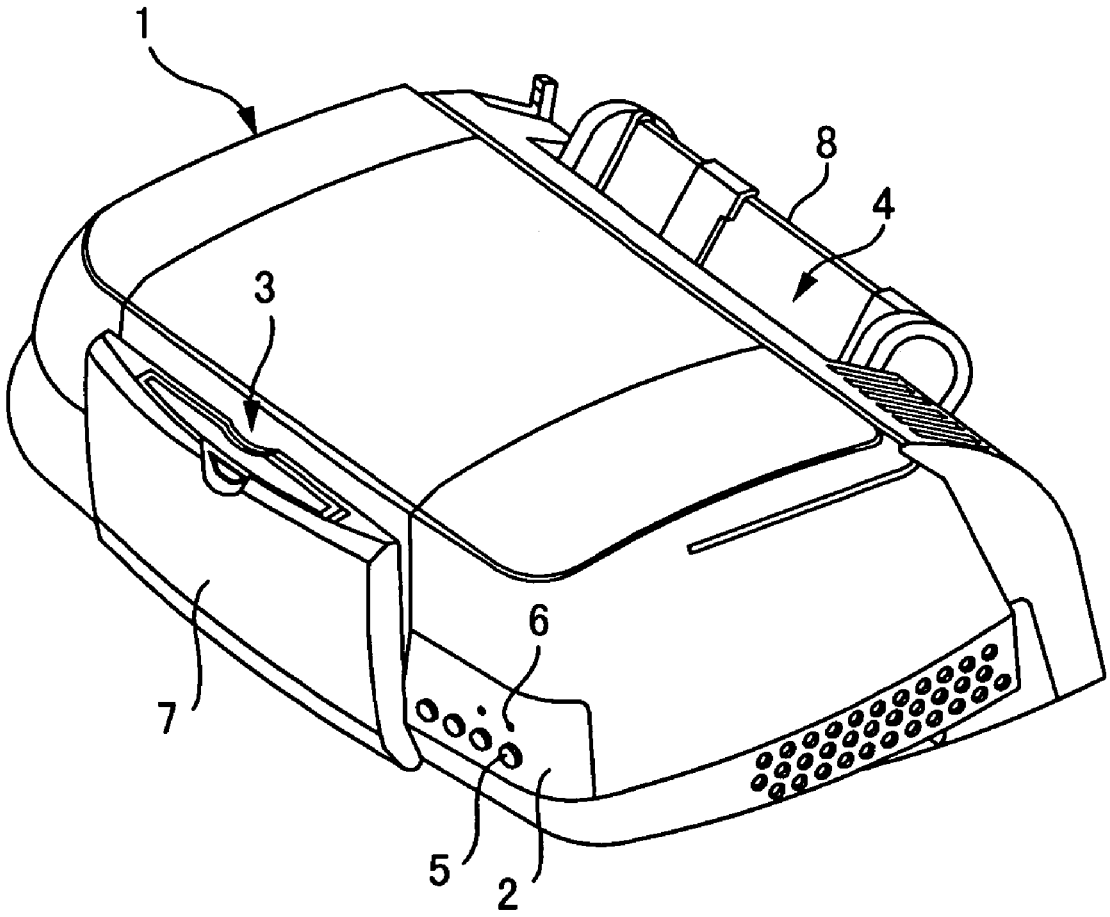
FIG. 1 is a perspective view showing an embodiment of an inkjet printer.

A legend of the main reference numerals used in the drawings is shown below.

1 inkjet printer
2 control panel
3 paper discharge section
4 paper supply section
control button
6 display lamp
7 paper discharge tray
8 paper supply tray
10 paper carrying unit
11A paper insert opening
11B roll paper insert opening
13 paper supply roller
14 platen
15 paper feed motor (PF motor)
16 paper feed motor driver (PF motor driver)
17A carry roller
17B paper discharge roller
18A free roller
18B free roller

20 ink ejection unit
21 ejection head
211 nozzle row
22 head driver
221 original drive signal generation section
222 mask circuit
223 drive signal correction circuit
30 cleaning unit
31 pump device
32 pump motor
33 pump motor driver
35 capping device
40 carriage unit
41 carriage
42 carriage motor (CR motor)
43 carriage motor driver (CR motor driver)
44 pulley
45 timing belt
46 guide rail
48 ink cartridge
49 ink cartridge
50 measuring instrument group
51 linear encoder
52 rotary encoder
53 paper detection sensor
53A lever
54 paper width sensor
541 light-emitting section
543 light-receiving section
60 control unit
61 CPU
62 timer
63 interface section
64 ASIC
65 memory
66 DC controller
67 host computer
80 ink recovery section
82 groove section
84 absorbing material
90 computer
91 video driver
93 display device
95 application program
96 printer driver
97 resolution conversion module
98 color conversion module
99 halftone module
100 rasterizer
101 user interface display module
102 UI printer interface module
1000 computer system
1102 computer
1104 display device
1106 printer
1108 input device
1108A keyboard
1108B mouse
1110 reading device
1110A flexible disk drive device
1110B CD-ROM drive device
1202 internal memory
1204 hard disk drive unit
S medium (paper)
P print region
P1 normal ejection region
P2 ejection amount reduction region

BEST MODE FOR CARRYING OUT THE INVENTION

At least the following matters will be made clear by the description in the present specification and the accompanying drawings.

A liquid ejecting apparatus comprises:

a liquid ejecting section that ejects a plurality of types of liquid toward a medium;

wherein among the liquids that are ejected from the liquid ejecting section and that reach a region that is outside the medium, an ejection amount of one or more types of the liquid is reduced.

According to such a liquid ejecting apparatus, it is possible to achieve a reduction in problems caused when some types of liquid, from among the plurality of liquids, reach the region that is outside the medium.

Furthermore, in this liquid ejecting apparatus, among the liquids that are ejected from the liquid ejecting section and that reach the region that is outside the medium, an ejection amount of the one or more types of the liquid may be reduced such that the amount becomes zero.

According to such a liquid ejecting apparatus, if the ejection amount of some types of liquid is reduced such that it becomes zero, then a further reduction of problems can be achieved.

Furthermore, in this liquid ejecting apparatus, the one or more types of the liquid may include a liquid whose permeability is lower than another type of liquid that is ejected from the liquid ejecting section.

According to such a liquid ejecting apparatus, problems caused when a liquid whose permeability is low reaches the region that is outside the medium can be reduced.

Furthermore, in this liquid ejecting apparatus, the one or more types of the liquid may include a liquid whose permeability is the lowest of all of the types of the liquids that are ejected from the liquid ejecting section.

According to such a liquid ejecting apparatus, problems caused when a liquid whose permeability is the lowest of all reaches the region that is outside the medium can be reduced.

Furthermore, in this liquid ejecting apparatus, the one or more types of the liquid may include a liquid whose permeability decreases on contact with another type of liquid that is ejected from the liquid ejecting section.

According to such a liquid ejecting apparatus, problems caused when a liquid whose permeability decreases when coming into contact with another type of liquid reaches the region that is outside the medium can be reduced.

Furthermore, in this liquid ejecting apparatus, the one or more types of the liquid may include a liquid that lowers a permeability of another type of liquid that is ejected from the liquid ejecting section on contact therewith.

According to such a liquid ejecting apparatus, problems caused when a liquid that lowers the permeability of another type of liquid when coming into contact with the other type of liquid reaches the region that is outside the medium can be reduced.

Furthermore, in this liquid ejecting apparatus, the one or more types of the liquid may include a liquid that accelerates coagulation of another type of liquid that is ejected from the liquid ejecting section.

According to such a liquid ejecting apparatus, problems caused when a liquid that accelerates coagulation of another type of liquid reaches the region that is outside the medium can be reduced.

Furthermore, in this liquid ejecting apparatus, there may be a plurality of types of the one or more types of the liquid.

According to such a liquid ejecting apparatus, problems caused when the liquids reach the region that is outside the medium can be reduced for the plurality of types of liquids.

Furthermore, in this liquid ejecting apparatus, it is also possible to provide a liquid recovery section that recovers liquid that has missed the medium.

According to such a liquid ejecting apparatus, liquid that has missed the medium can be recovered.

Furthermore, in this liquid ejecting apparatus, it is possible to provide a liquid recovery section that recovers liquid that has missed the medium; and the liquid recovery section may be provided with an absorbing material for absorbing the liquid that has been recovered.

According to such a liquid ejecting apparatus, by providing the absorbing material, the liquid that is recovered can be absorbed with the absorbing material and held therein.

Furthermore, in this liquid ejecting apparatus, the liquid may be ink.

According to such a liquid ejecting apparatus, problems caused when the ink from the liquid ejecting section reaches the region that is outside the medium can be reduced.

Further, a liquid ejecting apparatus comprises:

a liquid ejecting section that ejects a plurality of types of liquid toward a medium; and an ejection control section that controls ejection of the liquid from the liquid ejecting section;

wherein when the liquid ejecting section attempts to eject the liquid into a region that is determined to be outside the medium, the ejection control section prevents one or more types of liquid, of among the plurality of types of liquid, from being ejected into the region that is determined to be outside the medium.

According to such a liquid ejecting apparatus, when the liquid ejecting section attempts to eject the liquid into a region that is outside the medium, by not ejecting, into that region, one or more types of liquid of among the plurality of types of liquids, it is possible to avoid adverse influences caused when those types of liquid have missed the medium.

Further, a liquid ejecting method of ejecting a plurality of types of liquid toward a medium, comprises:

reducing an ejection amount of one or more types of the liquid of among the liquids that are ejected and that reach a region that is outside the medium.

According to such a liquid ejecting method, it is possible to achieve a reduction in problems caused when some types of liquid, from among the plurality of types of liquids, reach the region that is outside the medium.

Further, a liquid ejecting system comprises:

a computer; and a liquid ejecting apparatus that is connectable to the computer;

wherein the liquid ejecting apparatus includes: a liquid ejecting section that ejects a plurality of types of liquid toward a medium; wherein among the liquids that are ejected from the liquid ejecting section and that reach a region that is outside the medium, an ejection amount of one or more types of the liquid is reduced.

According to such a liquid ejecting system, it is possible to achieve a reduction in problems caused when some types of liquid, from among the plurality of types of liquids, that are ejected from the liquid ejecting apparatus reach the region that is outside the medium.

===Overview of Liquid Ejecting Apparatus===

Figure 2:
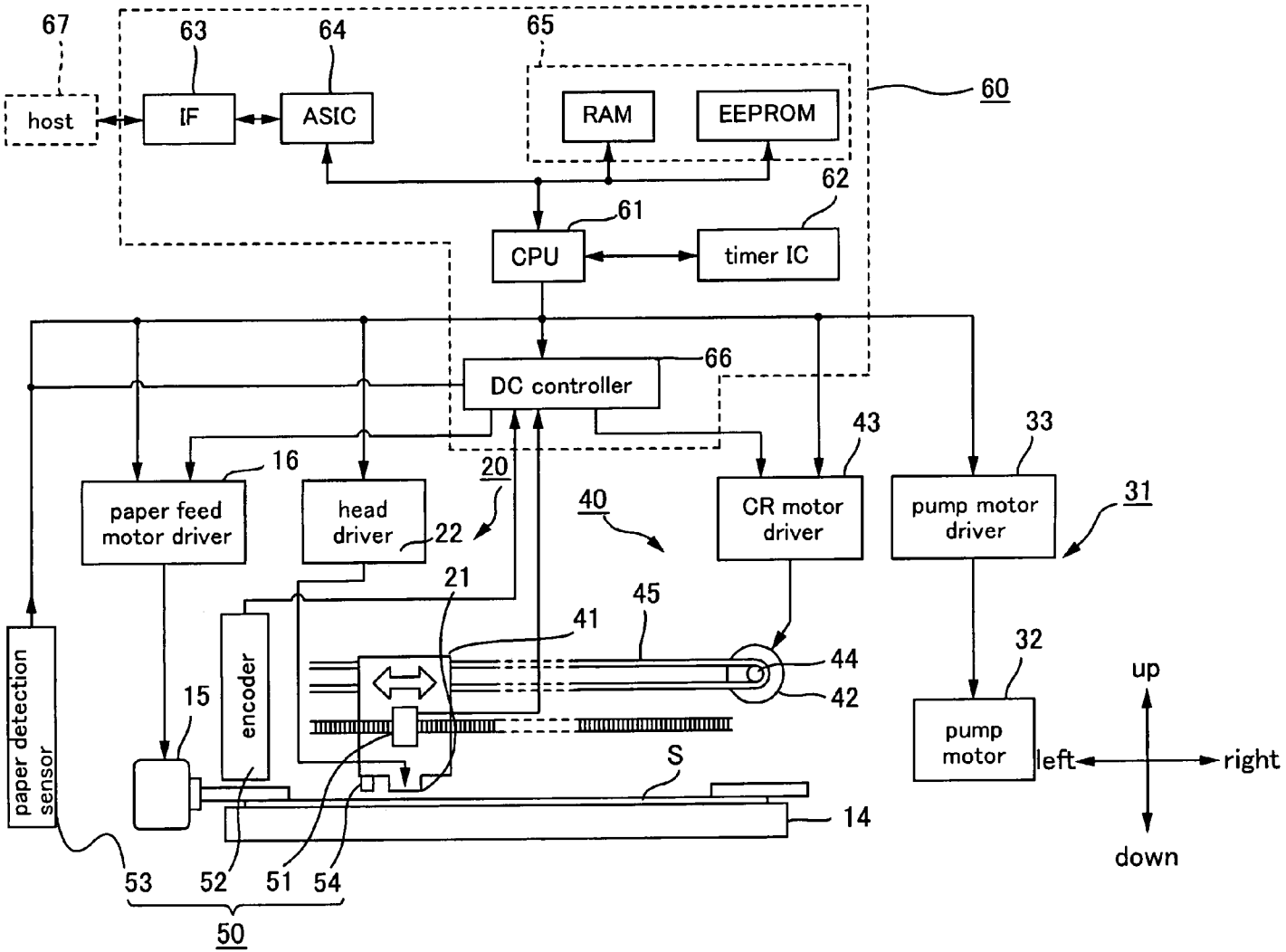
FIG. 2 is an explanatory diagram of the overall structure of the inkjet printer.
Figure 3:
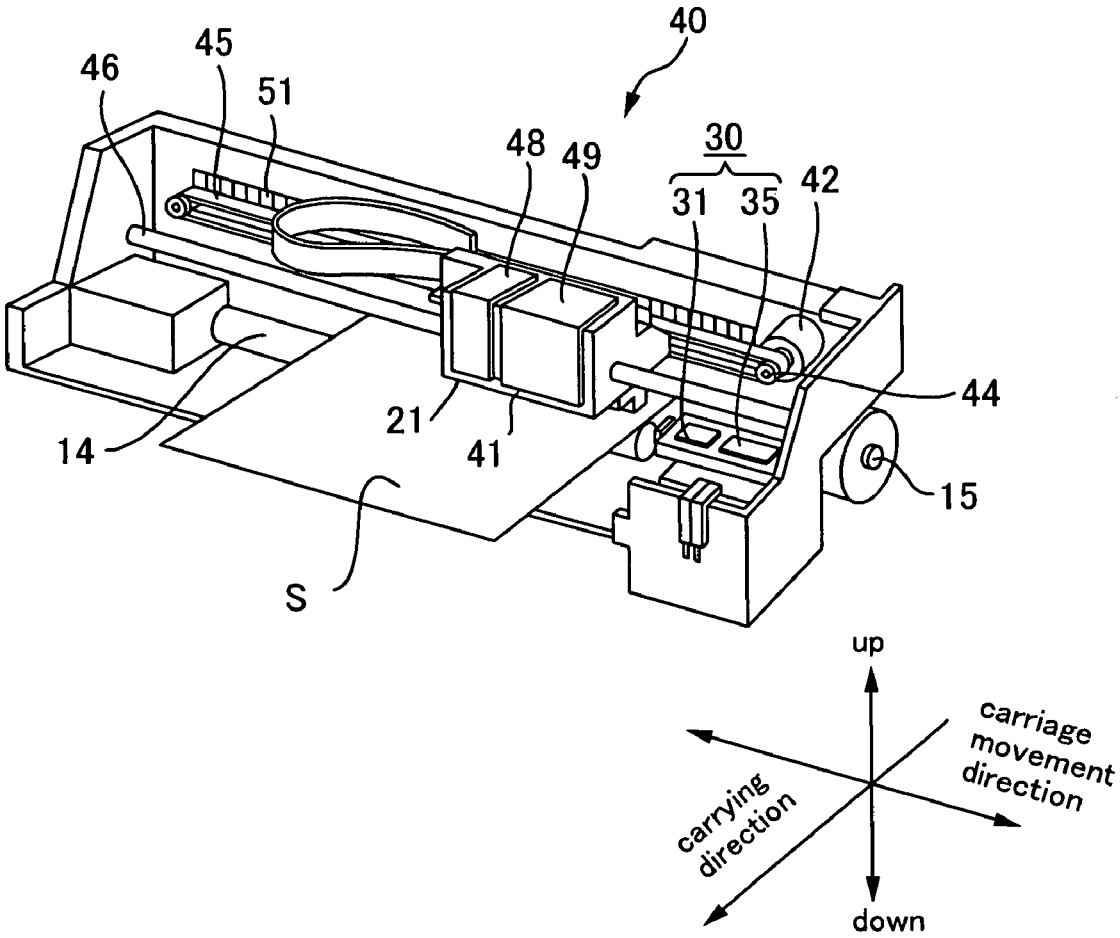
FIG. 3 is a diagram showing the carriage etc. of the inkjet printer.
Figure 4:
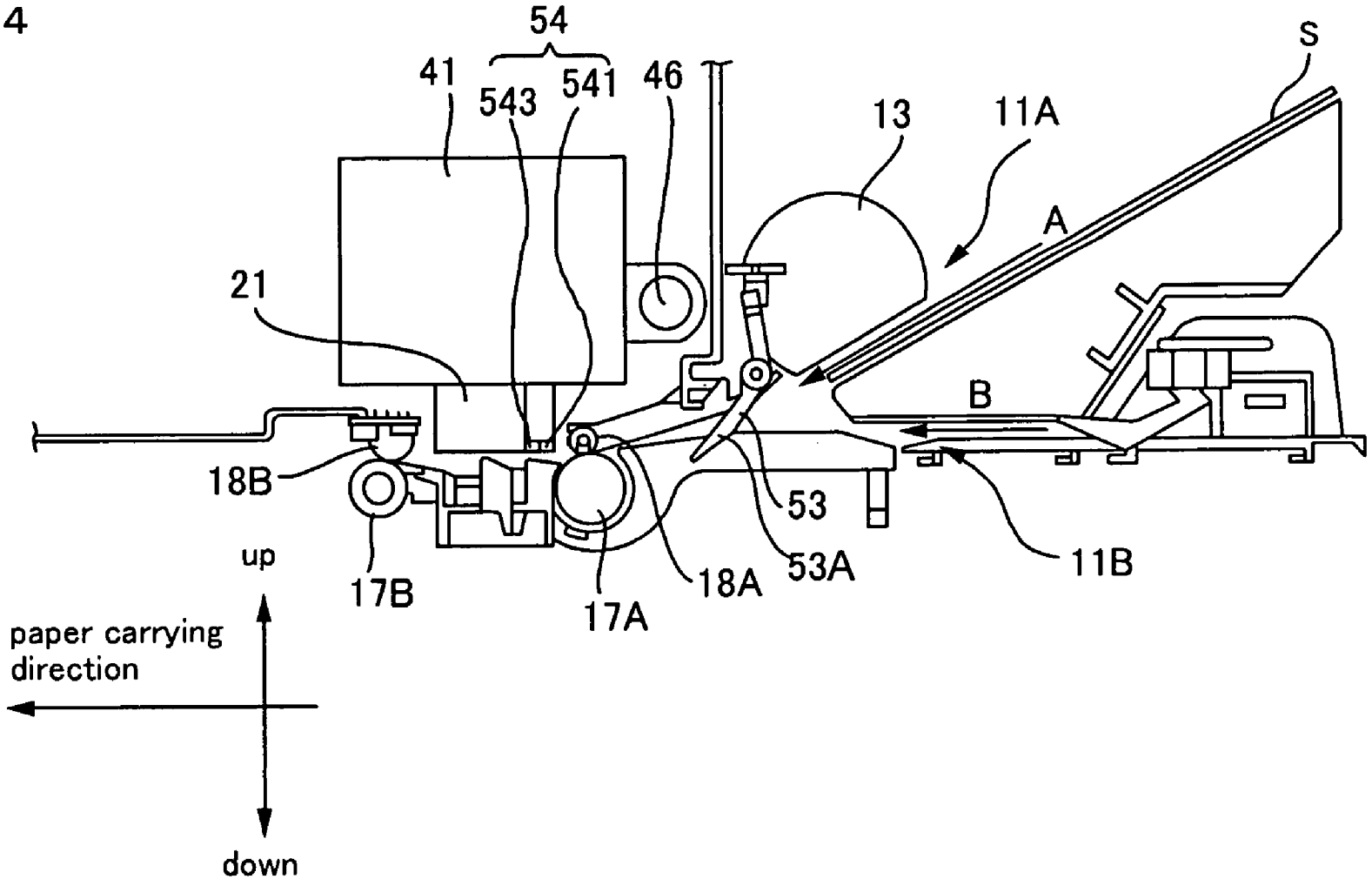
FIG. 4 is a diagram showing the carrying mechanism of the inkjet printer.
Figure 5:
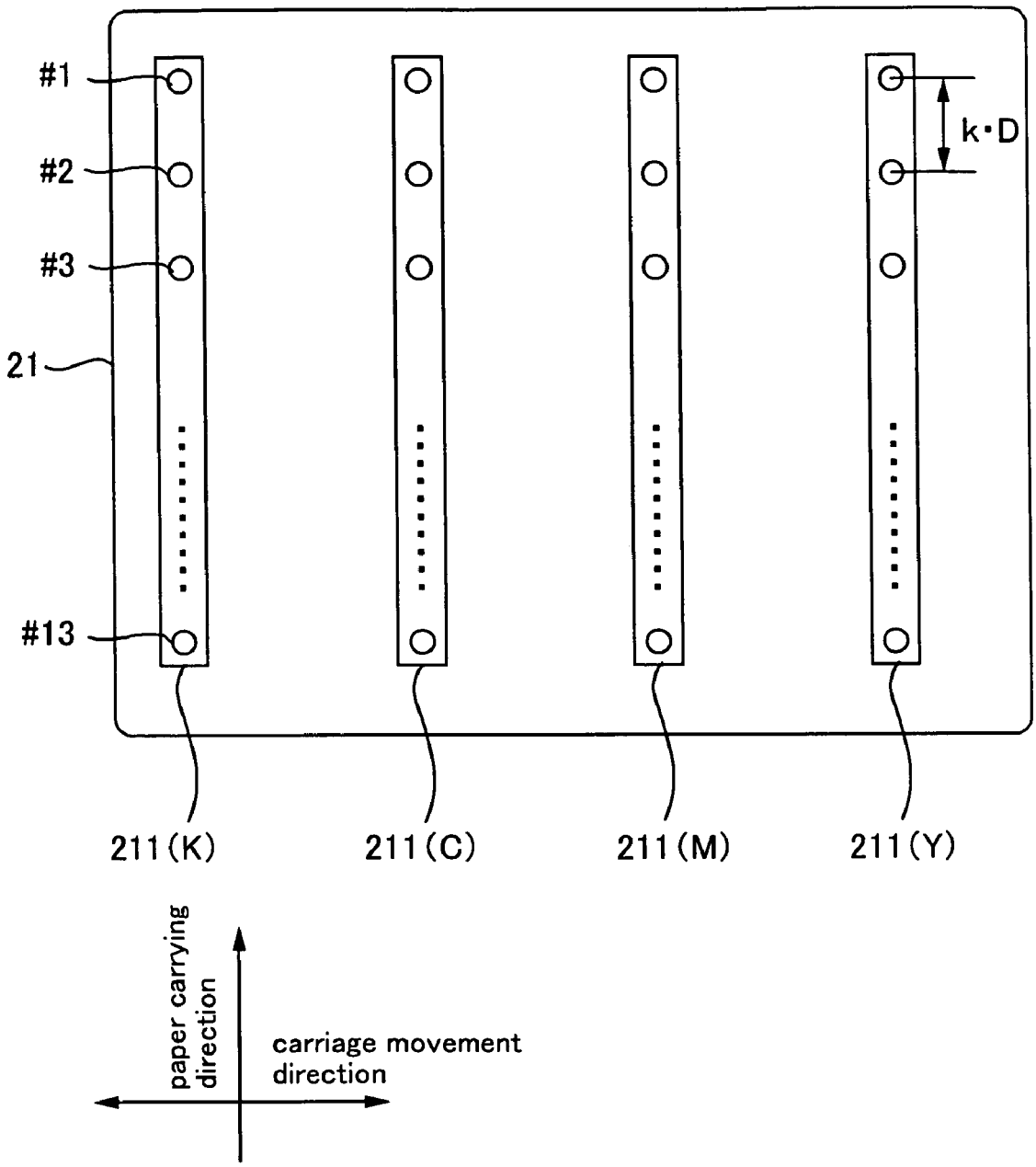
FIG. 5 is an explanatory diagram showing the arrangement of nozzles in the head.

An overview of an inkjet printer serving as an example of a liquid ejecting apparatus according to the present invention is described. FIG. 1 to FIG. 5 are diagrams for describing the overview of an embodiment of an inkjet printer 1. FIG. 1 shows the external appearance of an embodiment of the inkjet printer 1. FIG. 2 shows a block configuration of the inkjet printer 1, and FIG. 3 shows a carriage of the inkjet printer 1 and a surrounding section of the carriage. FIG. 4 shows a carry section of the inkjet printer 1 and a surrounding section of the carry section, and FIG. 5 shows a drive mechanism of the carry section of the inkjet printer 1.

As shown in FIG. 1, the inkjet printer 1 is provided with a structure in which a medium (medium to be printed) such as print paper that is supplied from the rear side is discharged from the front side. A control panel 2 and a paper discharge section 3 are arranged at the front side section, and a paper supply section 4 is provided at the rear side section. The control panel 2 is provided with various types of control buttons 5 and display lamps 6. The paper discharge section 3 is provided with a paper discharge tray 7 that blocks the paper discharge opening when the printer is not in use. A paper supply tray 8 is arranged at the paper supply section 4 to hold cut paper (not shown). It should be noted that the inkjet printer 1 may be provided with a paper feed structure that is capable of being used in printing not only print paper in single sheets, such as cut paper, but also media that are continuous, such as roll paper.

As shown in FIG. 2, the inkjet printer 1 is provided with a paper carrying unit 10, an ink ejection unit 20, a cleaning unit 30, a carriage unit 40, a measuring instrument group 50, and a control unit 60 as its primary components.

The paper carrying unit 10 is for feeding a medium such as paper, which is an example of a printing medium, into a printable position and making the paper move in a predetermined direction (the direction perpendicular to the paper face in FIG. 2 (hereinafter, this is referred to as the paper carrying direction)) by a predetermined movement amount during printing. That is to say, the paper carrying unit 10 functions as a carrying mechanism for carrying media such as paper. As shown in FIG. 4, the paper carrying unit 10 has a paper insert opening 11A and a roll paper insert opening 11B, a paper supply motor (not shown), a paper supply roller 13, a platen 14, a paper feed motor (hereinafter referred to as PF motor) 15, a paper feed motor driver (hereinafter, referred to as PF motor driver) 16, a carry roller 17A and paper discharge rollers 17B, and free rollers 18A and free rollers 18B. However, the paper carrying unit 10 does not necessarily have to include all of these structural elements in order to function as a carrying mechanism.

The paper insert opening 11A is where paper S, which is a medium, is inserted. The paper supply motor (not shown) is a motor for carrying the paper S that has been inserted through the paper insert opening 11A into the printer 1, and is constituted by a pulse motor. The paper supply roller 13 is a roller for automatically carrying the paper that has been inserted into the paper insert opening 11A or 11B into the printer, and is driven by the paper supply motor. The paper supply roller 13 has a transverse cross-sectional shape that is substantially the shape of the letter D. The peripheral length of a circumference section of the paper supply roller 13 is set longer than the carrying distance to the PF motor 15, so that using this circumference section, the medium to be printed can be carried up to the PF motor 15. It should be noted that a plurality of media are kept from being supplied at one time by the rotational drive force of the paper supply roller 13 and the frictional resistance of separation pads (not shown).

The platen 14 is a supporting means that supports the paper S during printing. The PF motor 15 is a motor for feeding the medium, for example paper, in the paper carrying direction, as shown in FIG. 2 and FIG. 4, and is constituted by a DC motor. The PF motor driver 16 is for driving the PF motor 15. The carry roller 17A is a roller for feeding the paper S that has been carried into the printer 1 by the paper supply roller 13 to a printable region, and is driven by the PF motor 15. The free rollers 18A (see FIG. 4 and FIG. 5) are provided in a position that is in opposition to the carry roller 17A, and they push the paper S toward the carry roller 17A by sandwiching the paper S between them and the carry roller 17A.

The paper discharge rollers 17B (see FIG. 4) are rollers for discharging the paper S for which printing has finished, to outside the printer. The paper discharge rollers 17B are driven by the PF motor 15 through a gear wheel that is not shown in the drawings. The free rollers 18B are provided in a position that is in opposition to the paper discharge rollers 17B, and they push the paper S toward the paper discharge rollers 17B by sandwiching the paper S between them and the paper discharge rollers 17B.

The ink ejection unit 20 is for ejecting ink onto media, for example paper. As shown in FIG. 2, the ink ejection unit 20 has an ejection head 21 and a head driver 22. The ejection head 21 has a plurality of nozzles, which are ink ejecting sections, and ejects ink intermittently from each of the nozzles. The head driver 22 is for driving the ejection head 21 so that ink is ejected intermittently from the ejection head 21.

The cleaning unit 30 is for keeping the nozzles of the ejection head 21 from becoming clogged, as shown in FIG. 3. The cleaning unit 30 has a pump device 31 and a capping device 35. The pump device 31 is for extracting ink from the nozzles in order to prevent the nozzles of the ejection head 21 from becoming clogged, and has a pump motor 32 and a pump motor driver 33. The pump motor 32 sucks out ink from the nozzles of the ejection head 21. The pump motor driver 33 drives the pump motor 32. The capping device 35 is for sealing the nozzles of the ejection head 21 when printing is not being performed (during standby) so that the nozzles of the ejection head 21 are kept from clogging.

The carriage unit 40 is for scan moving the ejection head 21 in a predetermined direction (in FIG. 2, the left and right direction of the paper face (hereinafter, this is referred to as the scanning direction)), as shown in FIG. 2 and FIG. 3. The carriage unit 40 has a carriage 41, a carriage motor (hereinafter, referred to as CR motor) 42, a carriage motor driver (hereinafter, referred to as CR motor driver) 43, a pulley 44, a timing belt 45, and a guide rail 46. The carriage 41 can be moved in the scanning direction (also referred to as the carriage movement direction), and the ejection head 21 is fastened to it (thus, the nozzles of the ejection head 21 intermittently eject ink as they are moved in the scanning direction). The carriage 41 also removably holds ink cartridges 48 and 49, which contain ink. The CR motor 42 is a motor for moving the carriage 41 in the scanning direction, and is constituted by a DC motor. The CR motor driver 43 is for driving the CR motor 42. The pulley 44 is attached to the rotation shaft of the CR motor 42. The timing belt 45 is driven by the pulley 44. The guide rail 46 is for guiding the carriage 41 in the scanning direction.

The measuring instrument group 50 includes a linear encoder 51, a rotary encoder 52, a paper detection sensor 53, and a paper width sensor 54. The linear encoder 51 is for detecting the position of the carriage 41. The rotary encoder 52 is for detecting the amount of rotation of the carry roller 17A. The paper detection sensor 53 is for detecting the position of the front end of the paper to be printed. The paper detection sensor 53 is provided in a position where it can detect the position of the front end of the paper S as the paper S is being carried toward the carry roller 17A by the paper supply roller 13. It should be noted that the paper detection sensor 53 is a mechanical sensor that detects the front end of the paper S through a mechanical mechanism. More specifically, the paper detection sensor 53 has a lever 53A that can be rotated in the paper carrying direction, and this lever 53A is arranged so that it protrudes into the path over which the paper S is carried. Thus the front end of the paper S comes into contact with the lever 53A and the lever 53A is rotated, and due to this, the paper detection sensor 53 detects the position of the front end of the paper S by detecting the movement of the lever 53A. The paper width sensor 54 is attached to the carriage 41. The paper width sensor 54 is an optical sensor having a light-emitting section 541 and a light-receiving section 543, and it detects whether or not the paper S is in the position of the paper width sensor 54 by detecting light that is reflected by the paper S. The paper width sensor 54 detects the position of the edges of the paper S while being moved by the carriage 41, thereby detecting the width of the paper S. The paper width sensor 54 can also detect the front end of the paper according to the position of the carriage 41. The paper width sensor 54 is an optical sensor, and thus detects positions with higher precision than the paper detection sensor 53.

The control unit 60 is for controlling the printer 1. The control unit 60 has a CPU 61, a timer 62, an interface section 63, an ASIC 64, a memory 65, and a DC controller 66. The CPU 61 is for carrying out the overall control of the printer, and sends control commands to the DC controller 66, the PF motor driver 16, the CR motor driver 43, the pump motor driver 33, and the head driver 22. The timer 62 periodically generates interrupt signals with respect to the CPU 61. The interface section 63 exchanges data with a host computer 67 provided outside the printer 1. The ASIC 64 controls, for example, the print resolution and the drive waveforms of the ejection head 21 based on print information sent from the host computer 67 through the interface section 63. The memory 65 is for reserving an area for storing the programs for the ASIC 64 and the CPU 61 and a work area, for instance, and has storage means such as a RAM or an EEPROM. The DC controller 66 controls the PF motor driver 16 and the CR motor driver 43 based on control commands sent from the CPU 61 and the output from the measuring instrument group 50.

When printing with such an inkjet printer 1, the paper S is intermittently carried for a predetermined carry amount by the carry roller 17A, and in between those intermittent carries, ink is ejected toward the paper S from the ejection head 21 while the carriage 41 moves in a direction that intersects the carrying direction of the carrying roller 17A, that is to say, in the scanning direction. Dots are formed on the paper S by the ink that is ejected, and numerous dots are formed to produce an image on the paper S.

===Ejection Mechanism of the Ejection Head 21===

FIG. 5 is a diagram showing the arrangement of the nozzles for ejecting ink that are provided in the lower surface section of the ejection head 21. As shown in the diagram, nozzle rows 211, which are made up of a plurality of nozzles #1 to #13 for each of the colors of black (K), cyan (C), magenta (M), and yellow (Y), are provided in the lower surface section of the ejection head 21. It should be noted that from among these colors, black (K) corresponds to an achromatic color, and cyan (C), magenta (M) and yellow (Y) correspond to chromatic colors. The nozzles #1 to #13 are arranged in a straight line in the carrying direction of paper 7. The nozzle rows 211 are positioned parallel to one another with spaces between them in the movement direction (scanning direction) of the ejection head 21. The nozzles #1 to #13 are provided with piezo elements (not shown) as drive elements for ejecting droplets of ink.

When a voltage of a predetermined duration is applied between electrodes provided at both ends of a piezo element, the piezo element expands for the duration of the voltage application and deforms a lateral wall of the ink channel. As a result, the volume of the ink channel is constricted by an amount corresponding to the expansion of the piezo element, and ink corresponding to this amount of constriction becomes an ink droplet, which is ejected from the relevant color nozzle #1 to #13.

Figure 6:
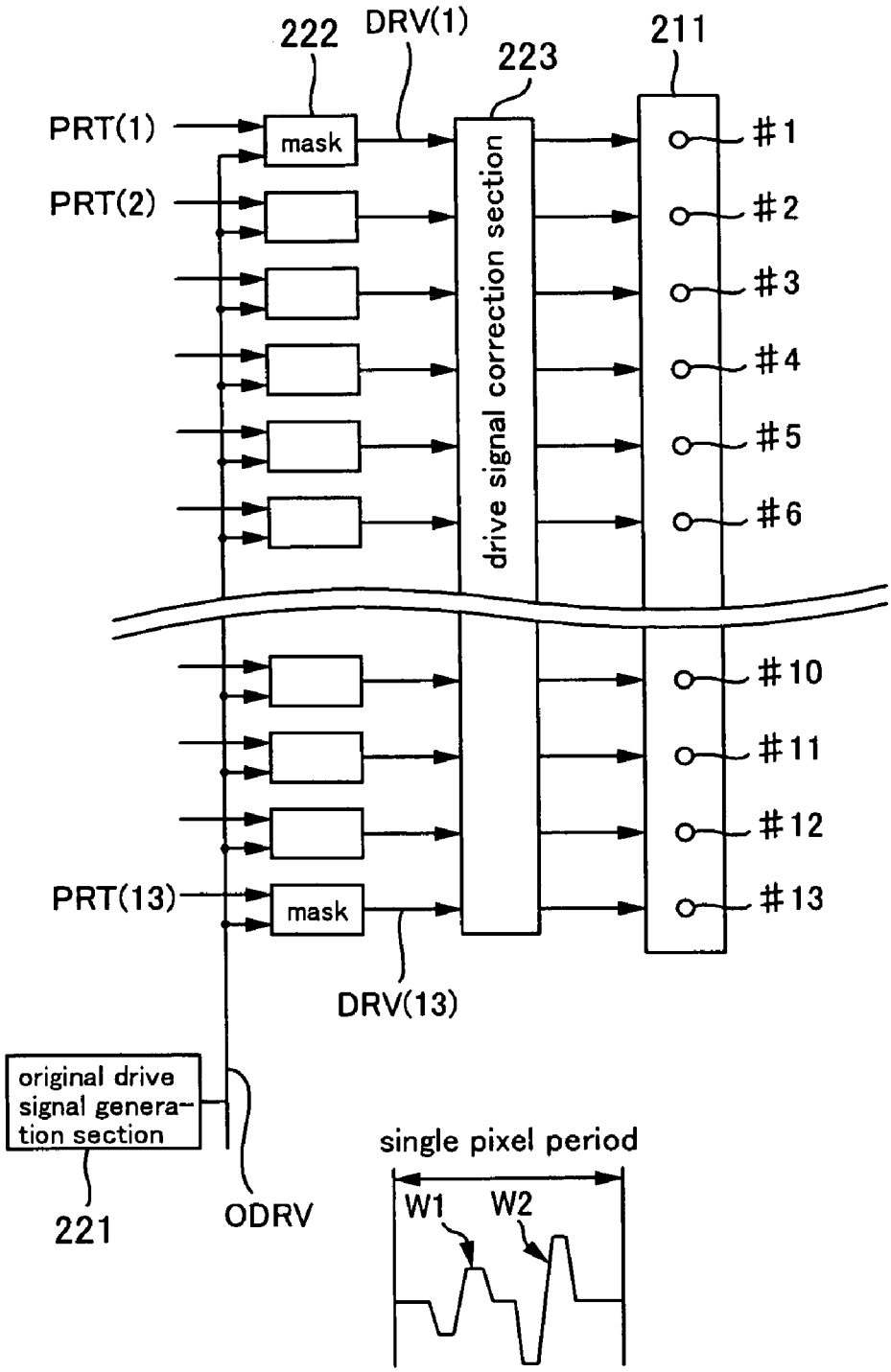
FIG. 6 is a block diagram showing the configuration within the head drive circuit.

FIG. 6 shows a drive circuit of the nozzles #1 to #13. As shown in the diagram, the drive circuit is provided with an original drive signal generation section 221, a plurality of mask circuits 222, and a drive signal correction circuit 223. The original drive signal generation section 221 creates an original signal ODRV that is shared by the nozzles #1 to #13. As shown in a lower portion of the diagram, the original signal ODRV is a signal that includes two pulses, a first pulse W1 and a second pulse W2, during the main scanning period of a single pixel (during the period that the carriage 41 crosses over a single pixel). The original signal ODRV created by the original drive signal generation section 221 is output to each mask circuit 222.

The mask circuits 222 are provided corresponding to each of the plurality of piezo elements that drive the nozzles #1 to #13 of the ejection head 21. The mask circuits 222 receive the original signal ODRV from the original signal generation section 221 and also receive print signals PRT(i). The print signals PRT(i) are pixel data corresponding to pixels and are binary signals having two bits of information for a single pixel. The mask circuits 222 are for blocking or allowing the original signal ODRV to pass, depending on the level of the print signal PRT(i). That is, when the print signal PRT(i) is level "0," the pulse of the original signal ODRV is blocked, but when the print signal PRT(i) is level "1," the pulse corresponding to the original signal ODRV is allowed to pass as it is and is output to the drive signal correction circuit 223 as a drive signal DRV.

The drive signal correction circuit 223 performs correction by shifting the timing of the waveforms of the drive signals DRV from the mask circuits 222. The width by which the timing of the waveforms of the drive signals DRV, which are corrected here, is shifted is adjusted as appropriate, based on instructions from the CPU 61 for example. That is, based on instructions from the CPU 61 for example, the drive signal correction circuit 223 can shift the waveforms of the drive signals DRV to a desired timing. The drive signals DRV that are corrected by the drive signal correction circuit 223 are output to the piezo elements of the nozzles #1 to #13. The piezo elements of the nozzles #1 to #13 are driven by the drive signals DRV from the drive signal correction circuit 223 and eject ink. It should be noted that the drive circuit that includes the original drive signal generation section 221, the plurality of mask circuits 222 and the drive signal correction section 223 corresponds to ejection control means of the present invention.

In the inkjet printer 1 according to the present embodiment, such a drive circuit for the nozzles #1 to #13 is provided for each of the nozzle rows 211, that is, for each of the nozzle rows 211(K), 211(C), 211(M) and 211(Y) of the colors black (K), cyan (C), magenta (M) and yellow (Y). Piezo elements of each nozzle row are driven individually.

It should be noted that in the present embodiment, the ink that is ejected from the ejection head is ink of the colors black (K), cyan (C), magenta (M) and yellow (Y); however the present invention is not limited to these, and also includes cases in which ink of other colors is ejected. Furthermore, the ink of the present invention is not limited to colored ink, but includes transparent, colorless clear inks. Other than these, in the present invention, liquids having special functions, whose object is to be used in printing, and that are used in conjunction with these inks, are also referred to as "ink" for convenience.

===Processing by the Host Computer===

Figure 7:
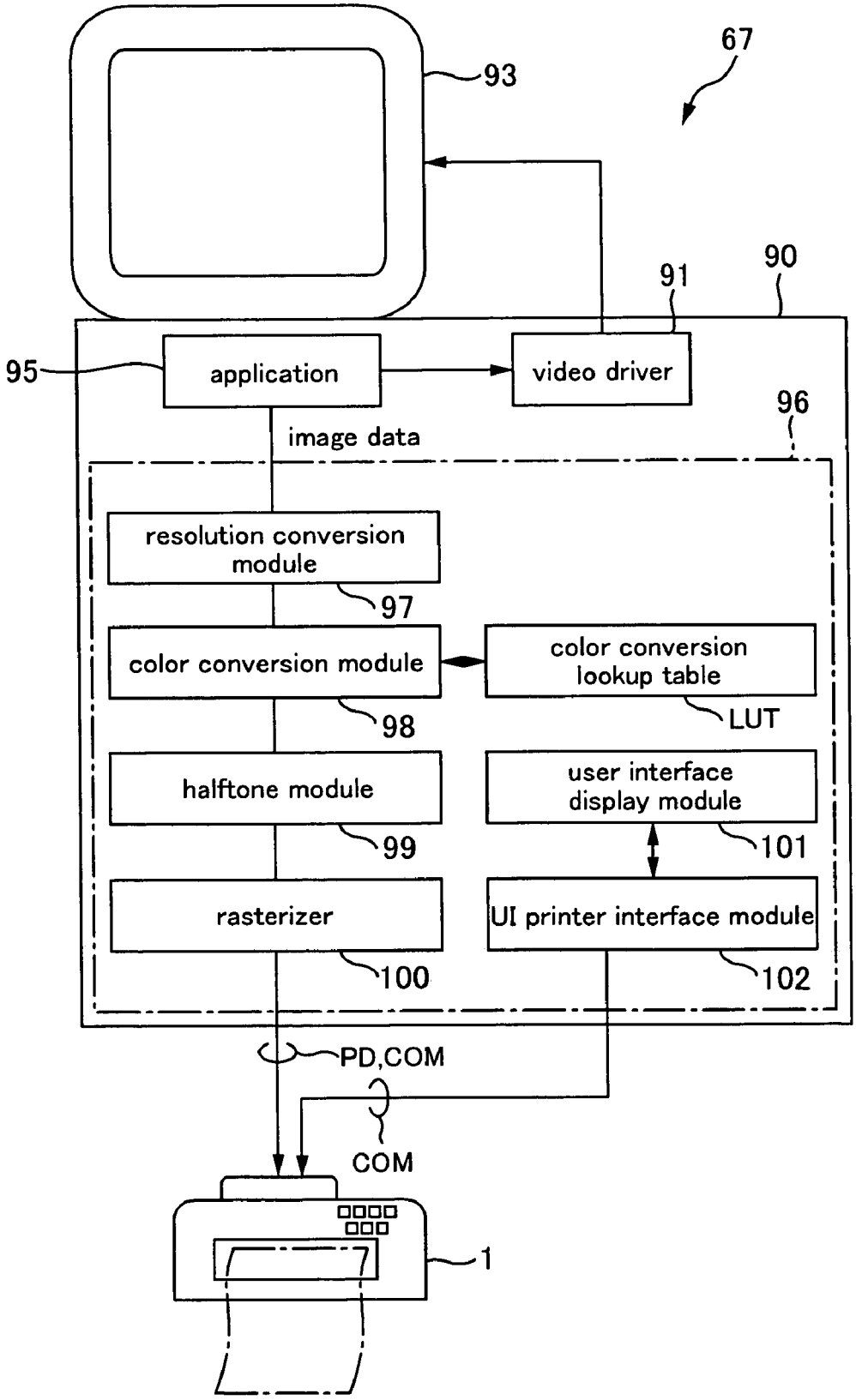
FIG. 7 is an explanatory diagram for describing processing on the host side.

FIG. 7 is a diagram for schematically describing the processing within the host computer 67. As shown in the diagram, the host computer 67 is provided by a computer 90, which is connected to the printer 1, and a display device 93. A computer program 96 known as a "printer driver" for controlling operation of the printer 1 is installed in the computer 90. As shown in the diagram, the printer driver 96 is operated by an application program 95 under a predetermined operating system that is installed on the host computer 67. A video driver 91 and the printer driver 96 are integrated into in the operating system. Print data PD to be forwarded to the inkjet printer 1 is output from the application program 95 via the printer driver 96. The application program 95, which carries out retouching of images, for example, performs desired processing with respect to an image to be processed, and also displays the image on the display device 93 via the video driver 91.

When the application program 95 issues a print command, the printer driver 96 of the computer 90 receives image data from the application program 95 and converts the image data into print data PD to be supplied to the inkjet printer 1. The printer driver 96 is internally provided with a resolution conversion module 97, a color conversion module 98, a halftone module 99, a rasterizer 100, a user interface display module 101, a UI printer interface module 102, and a color conversion lookup table LUT.

The resolution conversion module 97 performs the function of converting the resolution of color image data formed by the application program 95 into the print resolution. The image data that is thus converted in resolution is still image information composed of the three color components RGB. The color conversion module 98 references the color conversion lookup table LUT as it converts the RGB image data pixel-by-pixel into multi-gradation data of a plurality of ink colors that can be used by the printer 1.

The color-converted multi-gradation data has a gradation value of 256 scales, for example. This data is subjected to so-called "halftone processing" by the halftone module 99, creating halftone image data. The halftone image data is rearranged by the rasterizer 100 into the data order in which it is to be transferred to the printer 1, and is output as the final print data PD. The print data PD includes raster data indicating how dots are formed during each main scan and data indicating the sub-scan amount.

The user interface display module 101 has a function for displaying various types of user interface windows related to printing and a function for receiving user inputs in those windows.

The UI printer interface module 102 functions as an interface between the user interface (UI) and the printer 1. It interprets instructions given by users through the user interface and sends various commands COM to the printer 1, or conversely, it interprets commands COM received from the printer 1 and performs various displays on the user interface.

It should be noted that the printer driver 96 executes, for example, a function for sending and receiving various types of commands COM and a function for supplying print data PD to the printer 1. Such a program for executing the functions of the printer driver 96 is supplied in a format in which it is stored on a computer-readable storage medium. Examples of this storage medium include various types of media from which the host computer 67 can read data, such as flexible disks, CD-ROMS, magneto optical disks, IC cards, ROM cartridges, punch cards, printed materials on which a code such as a bar code is printed, internal storage devices (memories such as a RAM or a ROM) and external storage devices of the host computer 67. The computer program can also be downloaded onto the computer 90 via the Internet.

===Borderless Printing===

The inkjet printer 1 of the present embodiment has, as a print mode, a borderless printing mode in which "borderless printing" is performed, in addition to a normal print mode in which printing is carried out normally.

Figure 8:
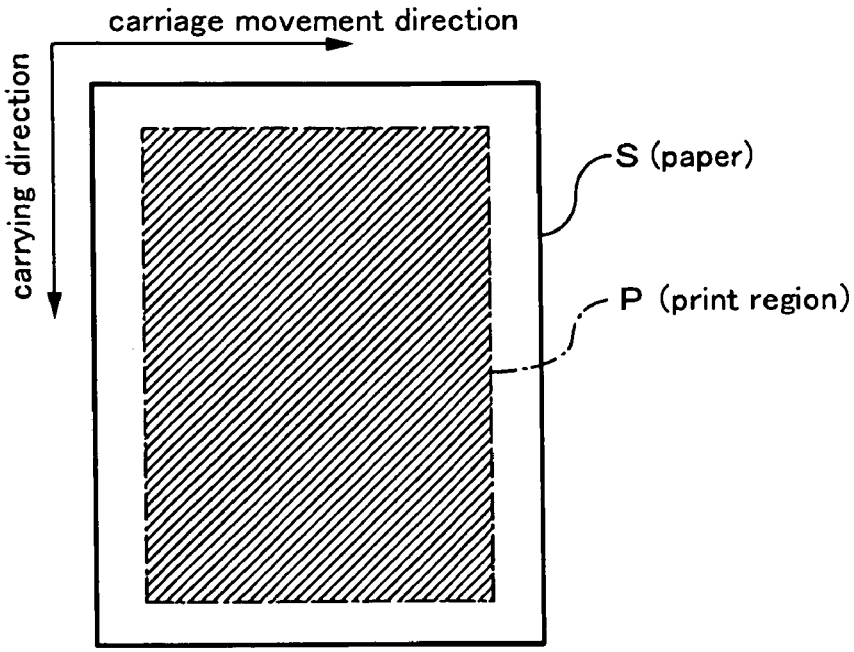
FIG. 8 is an explanatory diagram that describes the relationship between the print region and the paper during normal printing.

The normal printing mode is a mode of printing in which a print region P fits in on the paper S. FIG. 8 shows the relationship between the print region P and the size of the paper S in normal printing mode. As shown in the diagram, the print region P is set so as to fit within the paper S, and a blank space is formed on the peripheral section of the paper S, that is, on both the left and right edge sections and on both the top and bottom edge sections.

If the printing mode is set to normal, then the printer driver 96 creates print data PD based on image data obtained from the application program such that the print region P fits within the paper S. If image data whose print region P cannot fit within the paper S is to be processed, then a portion of the image that is expressed by the image data may be excluded from being printed, or the image may be reduced in size, for example, so that it fits on the paper S.

Figure 9:
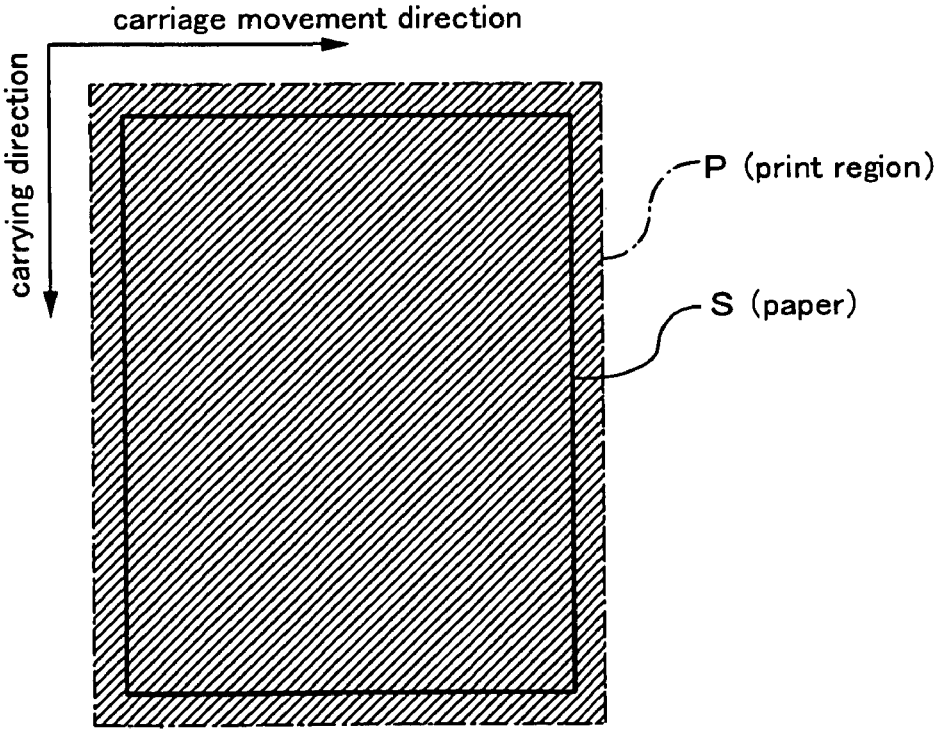
FIG. 9 is an explanatory diagram that describes the relationship between the print region and the paper during borderless printing.

On the other hand, the "borderless printing mode" is a mode of printing by which no blank space is formed on the paper S. Ink is also ejected into a region that is outside the paper S. FIG. 9 shows the relationship between the print region P and the size of the paper S in the "borderless printing mode". As shown in this diagram, in the "borderless printing mode", the print region P is set such that it is larger than the paper S. There are cases in which a blank space may not be formed in the peripheral section of the paper S, that is to say, on both right and left edge sections, and on both top and bottom edge sections of the paper S. It should be noted that it is not necessary that a blank space is formed on both right and left edge sections and both top and bottom parts of the paper S as shown in FIG. 9, but may also only be formed in one part of the paper S.

When the mode is set to the "borderless printing mode", the printer driver 96 can generate print data PD such that the print region P protrudes beyond the paper S. Here, if image data whose print region P becomes smaller than the paper S is to be processed, then the print region P can be expanded such that it covers the entire paper S. In this way, it is possible to carry out printing that has a superior appearance and that has no borders.

<Processing Ink that has Missed the Medium>

There is the possibility that the ink that has missed the paper S in the "borderless printing mode" will have adverse effects such as soiling the platen 14. Therefore, the printer 1 according to the present embodiment is provided with an ink recovery section 80 to recover such ink.

Figure 10:
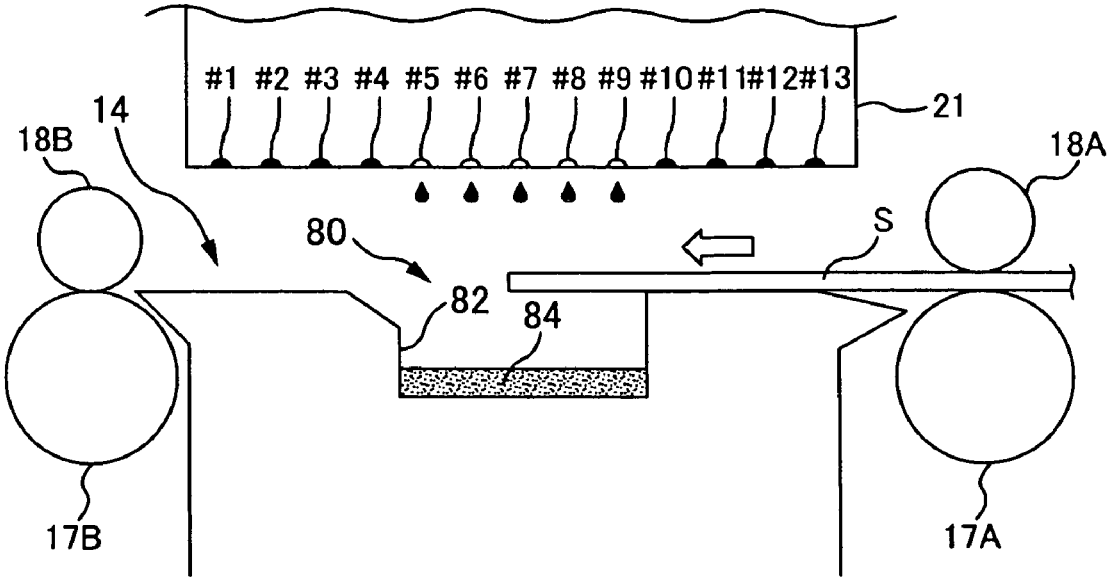
FIG. 10 is a cross-sectional view showing the ink recovery section.
Figure 11:
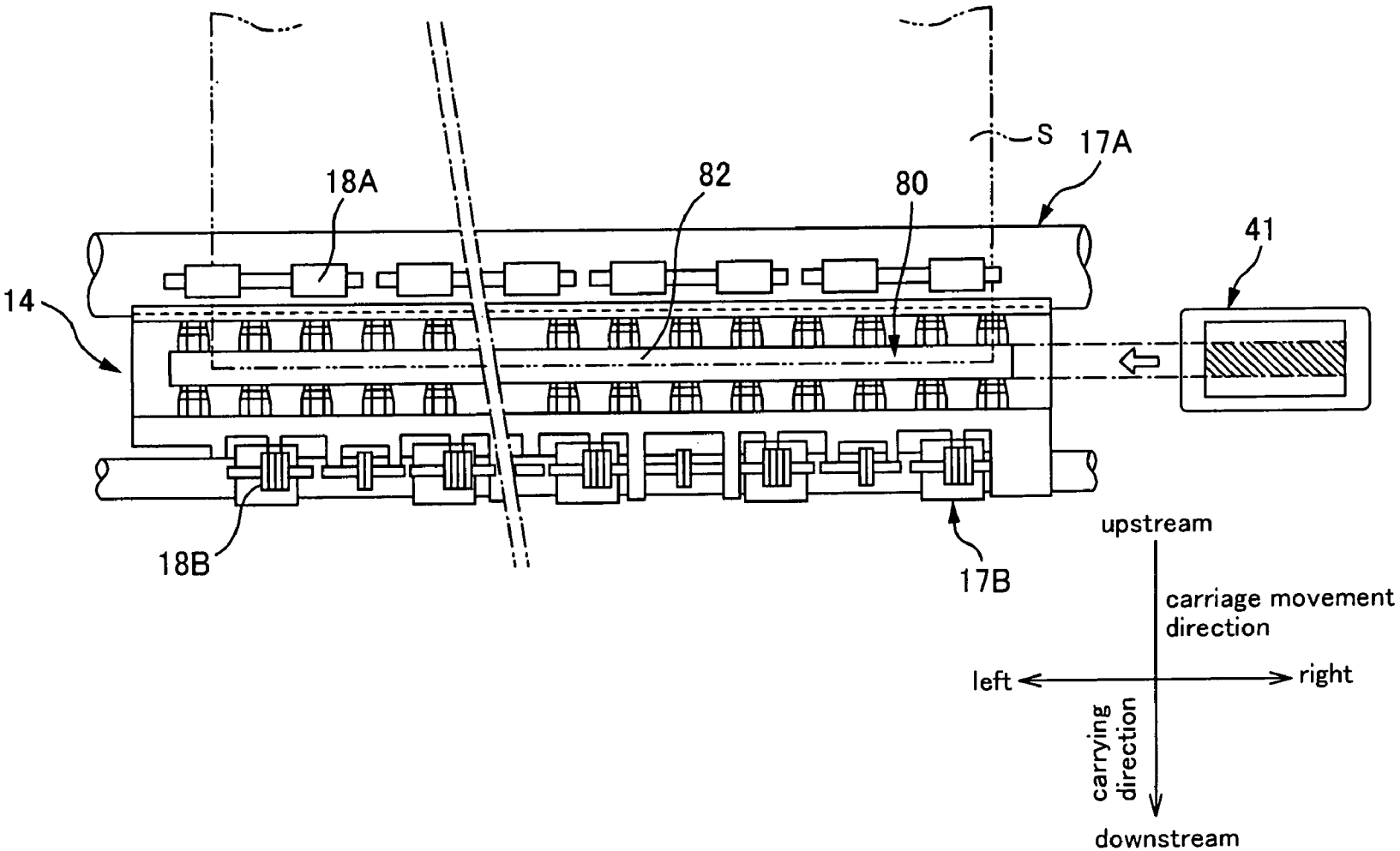
FIG. 11 is a plan view showing the ink recovery section.

FIG. 10 and FIG. 11 show an example of the ink recovery section 80. FIG. 10 is a cross-sectional view showing the ink recovery section 80, and FIG. 11 is a plan view showing the ink recovery section 80. As shown in FIG. 10, the ink recovery section 80 is formed on the platen 14 as a groove section 82 that has a concave cross section. As shown in FIG. 11, the groove section 82 is arranged in a straight line in the movement direction of the carriage 41 (scanning direction). Absorbing material 84 is arranged within the groove section 82 to absorb the ink that has been discarded. The absorbing material 84 is formed from various materials that are capable of absorbing the ink, such as sponge for example. The ink that is discarded can be absorbed by the absorbing material 84 when it reaches the absorbing material 84.

The ink that is recovered by the ink recovery section 80 is only the ink that is ejected from the nozzles #5 to #9, which are arranged in opposition to the ink recovery section 80, of among the nozzles #1 to #13 that are provided on the ejection head 21. The other nozzles, that is, nozzles #1 to #4 and #10 to #13 are not arranged in opposition with respect to the ink recovery section 80, and thus the ink that is ejected cannot be recovered by the ink recovery section 80. That is to say, the nozzles #1 to #4 and #10 to #13 are not used during "borderless printing", and only the nozzles #5 to #9 are used for printing.

It should be noted that in FIG. 10 and FIG. 11, the groove section 84 is only provided in a single position; however the present invention is not limited to this case, and groove sections may also be provided in a plurality of positions, such as in the paper feed direction (carrying direction) or in the scanning direction, for example.

===Ink Whose Ejection Amount is Reduced===

In the inkjet printer 1 according to the present embodiment, the ejection amount of some types of ink (liquid) is reduced if there is a possibility that such ink will reach a region outside the medium, even with "borderless printing". That is to say, the amount of ink of some types of ink, of among the inks ejected by the inkjet printer 1, that is ejected toward the region that is outside the medium is reduced.

The following are examples of inks whose ejection amount is reduced.

(1) Ink whose permeability is lower than other inks.

(2) Ink whose permeability decreases on contact with other inks.

(3) Ink that lowers the permeability of other inks on contact therewith.

Here, "(1) Ink whose permeability is low" means ink whose permeability is low with respect to materials such as paper or sponge that are generally absorptive with respect to liquids. More specifically, this includes inks that, for example, have absolutely no permeability with respect to absorptive material for reasons such as their molecule being large, or which are permeable with respect to such material but whose permeation speed is slow and which take a long time to for the liquid to permeate. Of course this is not limited to cases in which the entire components of the ink have a low permeability, and even if the permeability of one or more components of the composition is low, then it is regarded as an "ink whose permeability is low". For example, there are cases in which the permeability of the solvent of the ink is high, but the permeability of components such as pigments contained therein is low.

Furthermore, "(2) Ink whose permeability decreases on contact with other inks" means ink whose individual permeability is high, but whose material characteristics change on contact with other ink causing a decrease in permeability. More specifically, there are inks that cause chemical reactions on contact with other ink, causing a reduced permeability. In a similar manner to "(1) Ink whose permeability is low", such ink includes ink that has absolutely no permeability with respect to paper for example, and ink that is permeable with respect to the material, but whose permeation speed is slow and which thereby takes a long time to permeate. Here as well, of course, the case is not limited to that in which the entire composition of the ink has a low permeability after contact, and if even some components of the composition have low permeability, then this is regarded as an "ink whose permeability is low".

Furthermore, "(3) Ink that has a characteristic of lowering the permeability of other inks on contact therewith" includes, for example, inks that cause a chemical reaction on contact with other ink and that cause acceleration in coagulation of the other ink, so as to create a coagulate compound with the other ink.

When the inks (1) to (3) miss the medium S and are recovered in the ink recovery section 80 during borderless printing, there is the possibility that they will not readily permeate into the absorbing material 84 in the ink recovery section 80, and will remain behind. When the ink remains on the absorbing material 84, the ink accumulates and begins to pile up, and detrimental effects such as soiling of the medium S during printing or obstruction of the movement of the ejection head 21 can be expected to arise. In order to prevent occurrence of such detrimental effects, the printer 1 of the present embodiment is arranged so as to reduce the ejection amount of the inks (1) to (3) if there is a possibility that they will reach the region that is outside the medium S.

===Processing in the Printer Driver===

When the print mode is set to "borderless printing mode", the printer driver 96 generates print data PD such that the print region P protrudes beyond the medium S during creation of the print data PD based on image data obtained from the application program. However, as previously described, for ink that may possibly cause problems such as build-up if it reaches the region that is outside the medium S, if there is a possibility that it will reach a region that is outside the medium S, then the printer driver 96 creates print data PD such that the ejection amount is reduced.

Figure 12:
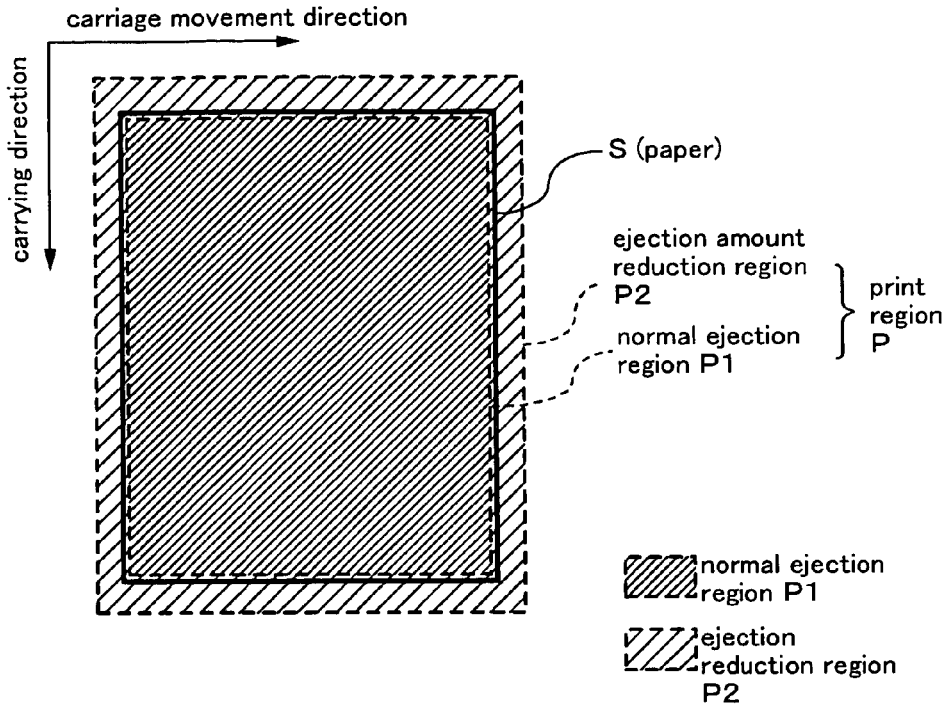
FIG. 12 is an explanatory diagram that describes the print region of the ink when the ejection amount is reduced.

FIG. 12 shows an example of the ejection state of the ink that may possibly cause problems if it reaches a region that is outside the medium. The region in which the ink is ejected, that is, the print region P, has a normal ejection region P1 and an ejection amount reduction region P2. The normal ejection region P1 is a region in which ink is ejected without any reduction in the ejection amount. The ejection amount reduction region P2 is a region in which ink is ejected with its ejection amount reduced. The ejection amount reduction region P2 is a region where there is a possibility that ink will reach a region that is outside the medium S, that is to say, it is provided from the outer periphery of the paper (medium) S to a part that protrudes beyond the exterior of the paper S.

Here, as the method for reducing the ejection amount of ink in the ejection amount reduction region P2, there are methods such as reducing the amount that is ejected from each nozzle per time (per one drop), or performing thinning-out, for example. If the ejection amount per time (per one drop) is to be reduced, then print data PD is created such that a smaller dot will be formed. Furthermore, in the case of performing thinning-out, the print data PD is created such that at a predetermined interval, ink droplets are not ejected.

It should be noted that for ink of types other than those which may cause problems if they reach a region outside the medium, print data PD is created such that such that the print region P protrudes beyond the medium S, as shown in FIG. 9.

Furthermore, the ejection amount reduction region P2 that is set here does not necessarily have to be arranged such that it protrudes beyond the paper S as shown in the diagram, and it can be set on the peripheral section of the paper S with a certain degree of leeway.

Furthermore, the "region that may reach the region that is outside the medium" is set by the printer driver 96 etc. based on information about the paper S, such as the size of the medium (paper) S that is to be printed or detection information from various sensors.

Furthermore, the process of providing the ejection amount reduction region P2 as described previously for the ink that may cause problems if it reaches the region that is outside the medium can be carried out when the data is converted into multi-gradation data for each ink color by the color conversion module 98, or when it is subjected to halftone processing by the halftone module 99.

As described above, for the ink that may cause problems such as accumulation if it reaches the region that is outside the medium S, if there is a possibility that such ink will reach the region that is outside the medium, then print data PD is created such that the ejection amount is reduced. In this way, the amount that reaches the region that is outside the medium S can be reduced, and thus it is possible to achieve a reduction in the problems that this type of ink causes when it reaches the region that is outside the medium. That is to say, with the inkjet printer 1 of the present embodiment, the amount of accumulation on the absorbing material 84 of ink, among the inks that are ejected from the ejection head 21, that has a possibility of accumulating on the absorbing material 84 when it is recovered by the absorbing material 84 of the ink recovery section 80 is reduced when performing "borderless printing mode". Thus, it is possible to eliminate problems such as soiling of the medium that is printed and obstruction of the movement of the ejection head 21 caused by the ink that has piled up on the absorbing material 84 of the ink recovery section 80.

===Other Methods for Reducing the Ejection Amount===

Figure 13:
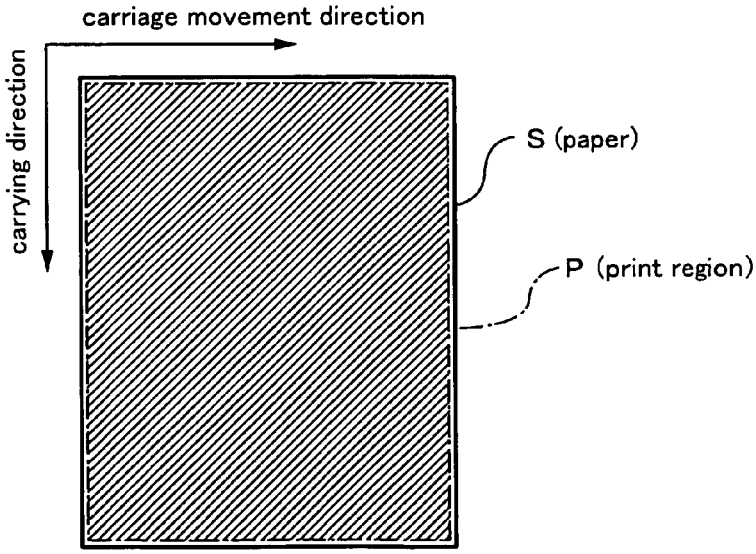
FIG. 13 is an explanatory diagram that describes the print region of the ink when the ejection amount is set to zero.

FIG. 13 is a diagram that describes an example of a case where the ejection amount is set to zero for ink that may cause problems if it reaches the region that is outside the medium S, without providing an ejection amount reduction region P2 such as that shown in FIG. 12. Here, for the ink that may cause problems if it reaches the region that is outside the medium S, the print region P is arranged such that the print region P does not protrude beyond the medium S.

It should be noted that the print region P arranged here can be set such that it fits just within the size of the paper S, as shown in the diagram, or it can be provided with some leeway, such that a blank space is provided on the peripheral section of the paper S. Of course, the print region P can also be set such that it is provided with a sufficient blank space, as in the "normal printing mode" described previously and shown in FIG. 8.

In this way, as for ink that may cause problems in case it reaches the region that is outside the medium S, if there is a possibility that the ink will reach the region that is outside the medium S, then ejection is kept from being performed by setting the ejection amount to zero, instead of reducing the ejection amount. Thus, problems that are caused when such ink reaches the region that is outside the medium can be reliably eliminated.

===Other Methods For Borderless Printing===

In the "borderless printing" described in FIG. 9, the print region P was set such that it was larger than the paper S; however, it is not absolutely necessary to execute such a method when performing "borderless printing".

Figure 14:
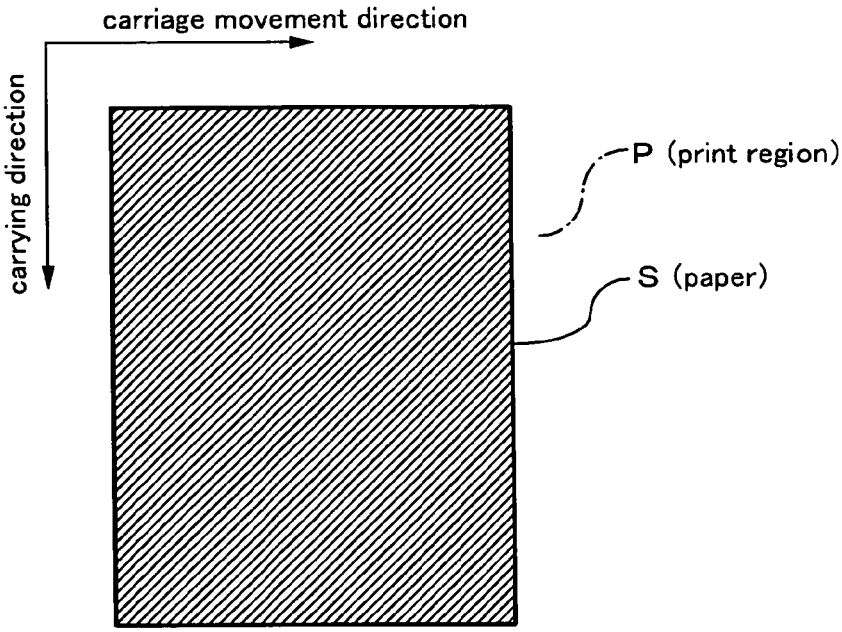
FIG. 14 is an explanatory diagram that describes one example of another method for borderless printing.

FIG. 14 is a diagram that describes another example of a method for "borderless printing". As shown in the diagram, the print region P is provided up to the very limit of the region of the paper S. Even if such a print region P is set to the very limit of the region of the paper S in this way, printing can be performed such that only a minimum blank space is formed in the edge section of the paper S.

Figure 15:
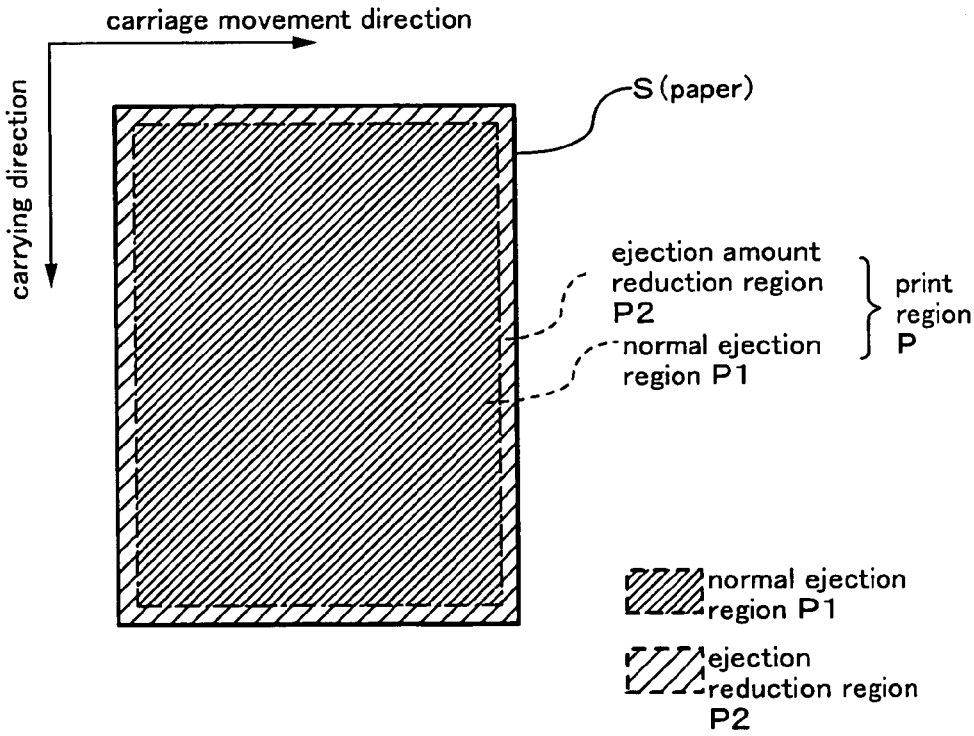
FIG. 15 is an explanatory diagram that describes an example of a method for reducing the amount of ink that is ejected in another method for borderless printing.

FIG. 15 is a diagram that describes an example of a method for setting the ejection amount reduction region P2 for ink that may cause problems if it reaches the region that is outside the medium S with respect to the above-described method for "borderless printing". Here, the ejection amount reduction region P2 is provided on the peripheral section of the paper S. Furthermore, the normal ejection region P1 is provided on the inner side thereof, surrounded by the ejection amount reduction region P1.

In the case of the method for "borderless printing" shown in FIG. 14, it is also possible to set the ejection amount reduction region P2 to be the region that is the very limit of the peripheral section of the paper S as shown in FIG. 15. Such a region is set to the very limit of the peripheral section of the paper S because there is a possibility that the ink may reach the region that is outside the medium S if positional displacement of the paper S occurs. For ink that may cause problems if it reaches the region that is outside the medium S, the occurrence of problems can be reduced by reducing the amount of ink ejected with respect to such regions.

===Methods for Verifying Permeability===

<Methods for Verifying Permeability (1)>

Figure 16:
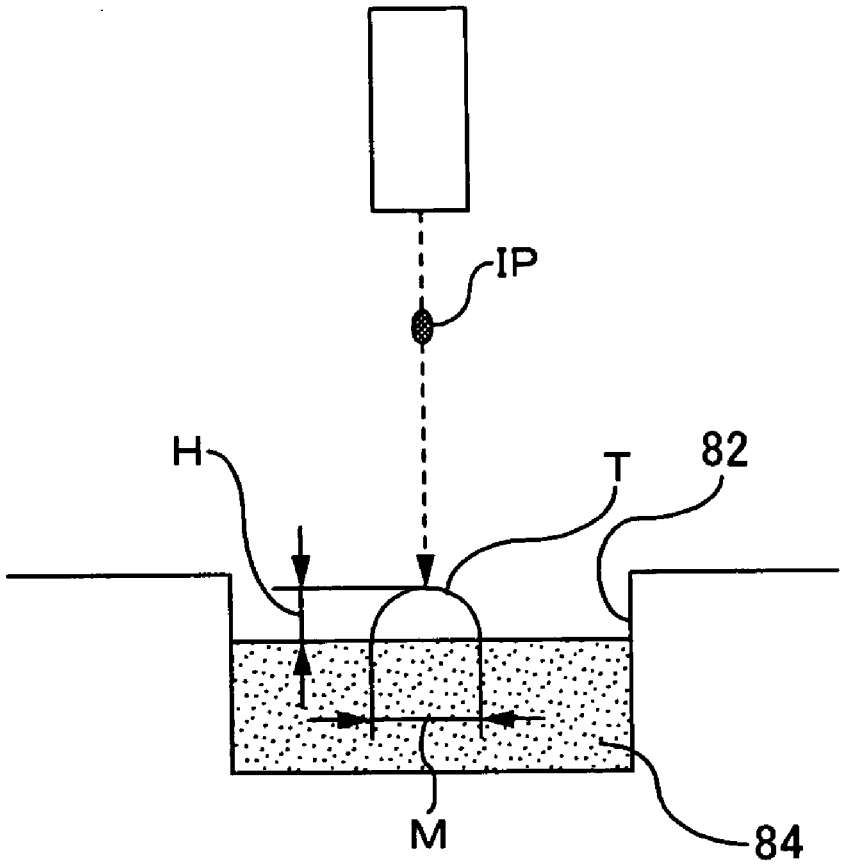
FIG. 16 is an explanatory diagram showing an example of a method for verifying the permeability of the ink.

An example of a method for verifying the permeability of the ink is described next. FIG. 16 is a diagram for describing an example of the verification method. Verification is performed by providing a groove section 82, which is assumed as an ink recovery section, as shown in the same diagram, arranging a sponge as the absorbing material 84 within the groove section 82, and dripping ink IP from above onto the sponge 84. Comparison is made by dripping the same type of ink IP onto the same point of the sponge 84 at a predetermined time interval for a predetermined number of times. The amount of ink IP that is dripped per time is set to be the same. For example, the condition is set such that drops of 25 pl are dripped 200 times at 1 second intervals.

Whether or not the ink remains on the sponge 84 is confirmed by sight etc., or the amount of ink that remains on the sponge 84 is determined from the height H and size (diameter M), for example, of ink T that remains on the sponge 84. Such an investigation is carried out for different types of ink, for example, for different colors. From the result, if the ink remains on the sponge 84, or if the height H or size (diameter M), for example, of the ink T exceeds a predetermined reference, or if it is comparatively larger than another ink, then it can be established that the ink is low in permeability.

<Methods for Verifying Permeability (2)>

Next, verification methods for when one of the ink decreases in permeability when two types of ink are placed in contact with one another, and for when an ink accelerates coagulation of another ink, are described. Even in such cases, in a similar manner to the verification method (1), verification is performed by dripping ink IP from above onto a sponge 84 that is arranged as the absorbing material inside a grooved section 82, which is assumed as an ink recovery section 80, as shown in FIG. 16. However, in this method, two types of ink are used, and comparison is made by dripping these two types of ink for a predetermined number of times at a predetermined time interval onto the same point. The amount of ink IP that is dripped per time is set to be the same. For example, the condition is set such that drops of 25 pl are dripped 200 times at 1 second intervals. At this time, it is also preferable to investigate examples in which the two types of ink are dripped individually, as comparative examples.

Accordingly, whether or not the ink remains on the sponge 84 is confirmed by sight etc., or the amount of ink that remains on the sponge 84 is determined from the height H and size (diameter M), for example, of ink T that remains on the sponge 84. Such an investigation is carried out for different types of ink, for example, for different colors. From the result, it is verified whether or not the permeability of ink has decreased based on the presence/absence of ink remaining on the sponge 84, or by comparing the height H and the size (diameter M), for example, of the ink T with a predetermined reference or other inks.

===Configuration of Liquid Ejection System Etc.===

The following is a description of a printing system, as an example of a liquid ejecting system according to the present invention, provided with an inkjet printer as a liquid ejecting apparatus.

Figure 17:
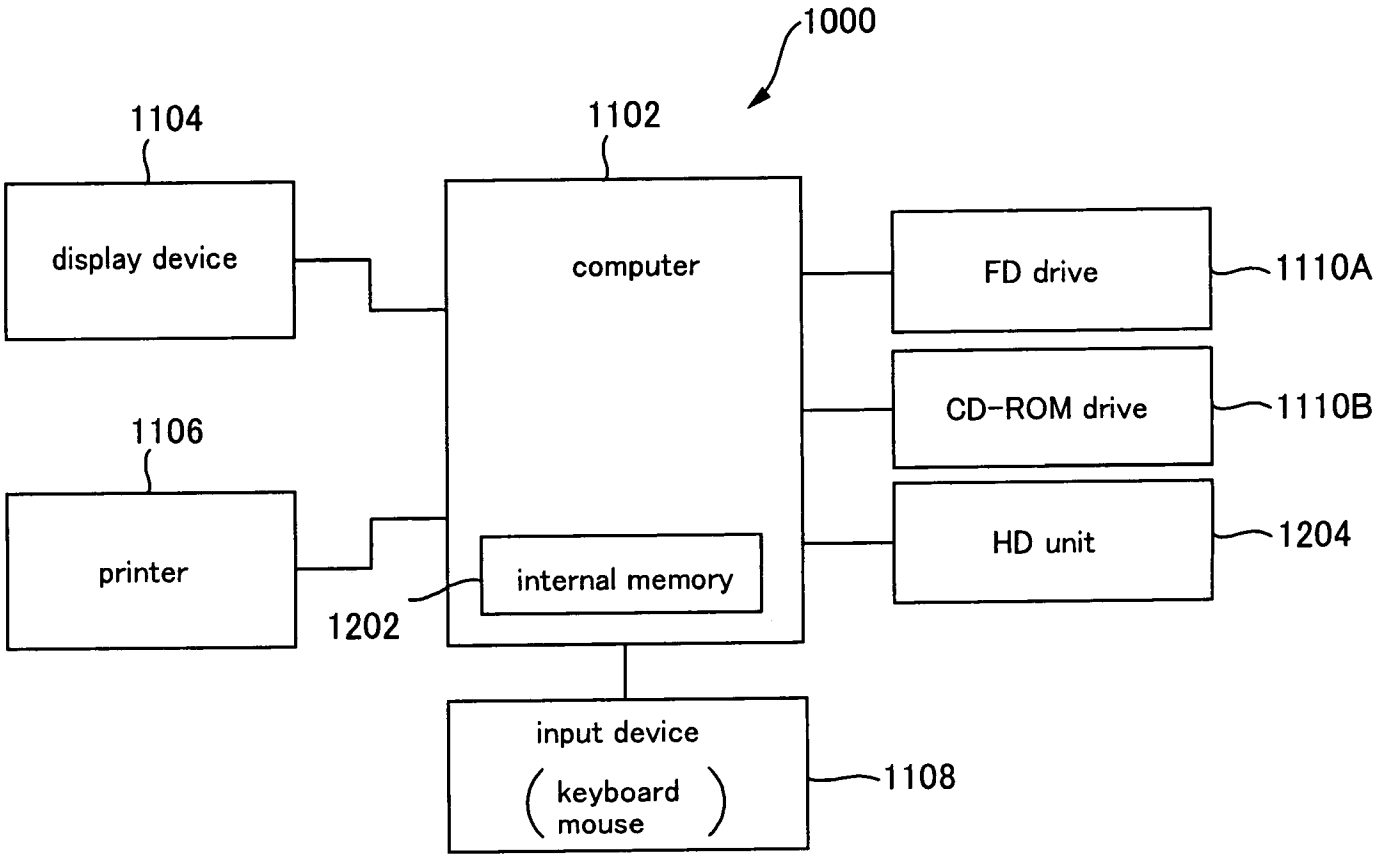
FIG. 17 is a structural diagram of the external appearance of a computer system.

FIG. 17 is an explanatory diagram showing the external structure of the liquid ejecting system. A liquid ejecting system 1000 is provided with a computer 1102, a display device 1104, a printer 1106, an input device 1108, and a reading device 1110. In this embodiment, the computer 1102 is accommodated within a mini-tower type housing; however, there is no limitation to this. A CRT (cathode ray tube), a plasma display, or a liquid crystal display device, for example, is generally used as the display device 1104, but there is no limitation to this. The printer 1106 is the printer described above. In this embodiment, the input device 1108 is a keyboard 1108A and a mouse 1108B, but it is not limited to these. In this embodiment, a flexible disk drive device 1110A and a CD-ROM drive device 1110B are used as the reading device 1110, but the reading device 1110 is not limited to these, and it may also be a MO (magnet optical) disk drive device or a DVD (digital versatile disk), for example.

Figure 18:
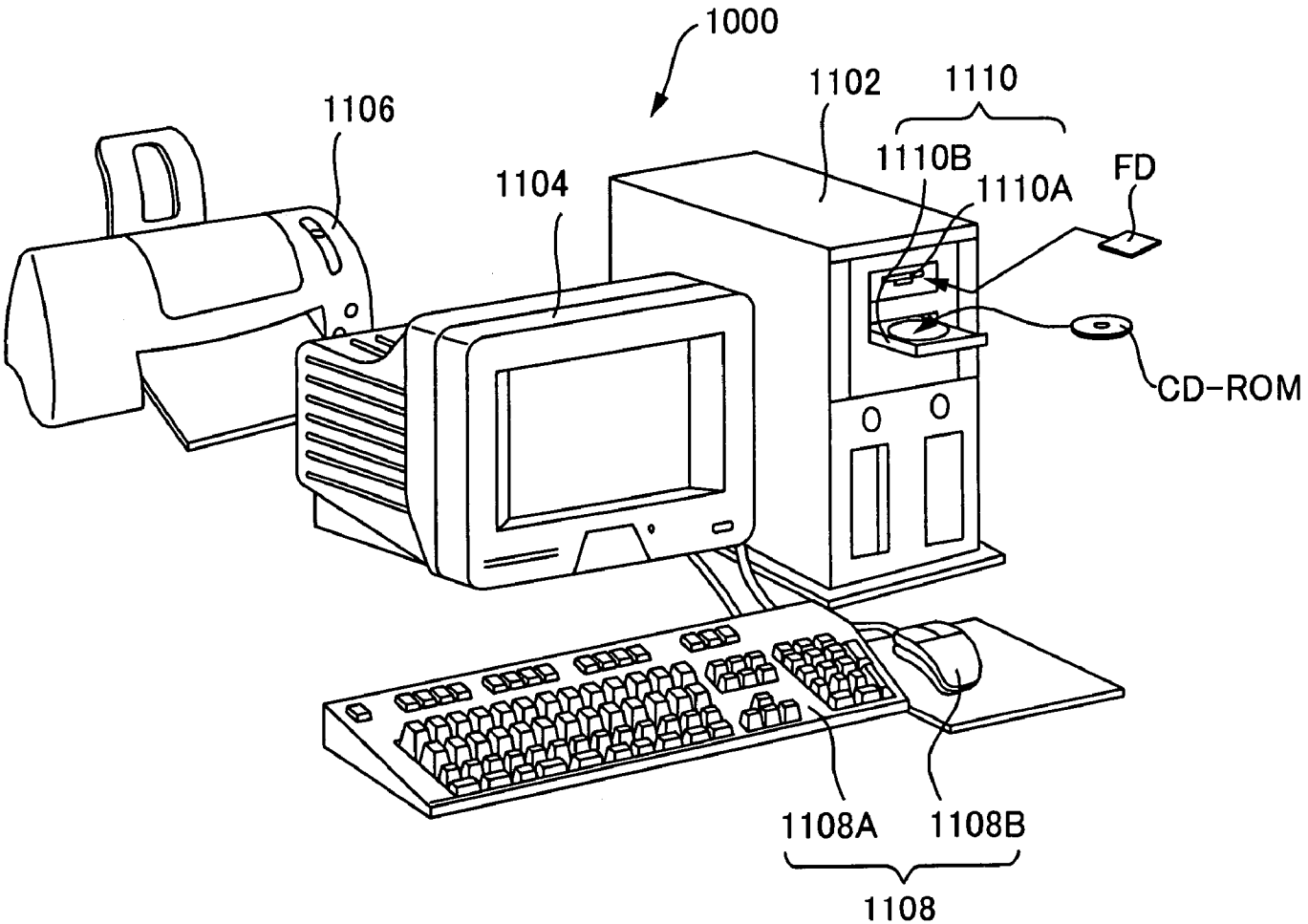
FIG. 18 is a block diagram showing a configuration of the computer system.

FIG. 18 is a block diagram showing the configuration of the liquid ejecting system shown in FIG. 17. An internal memory 1202 such as a RAM within the housing accommodating the computer 1102 and, also, an external memory such as a hard disk drive unit 1204 are provided.

A computer program for controlling the operation of the above printer can be downloaded onto the computer 1000, for example, connected to the printer 1106 via a communications line such as the Internet, and it can also be stored on a computer-readable storage medium and distributed, for example. Various types of storage media can be used as this storage medium, including flexible disks FDs, CD-ROMs, DVD-ROMs, magneto optical disks MOs, hard disks, and memories. It should be noted that information stored on such storage media can be read by various types of reading devices 1110.

In the above description, an example was described in which the computer system is constituted by connecting the printer 1106 to the computer 1102, the display device 1104, the input device 1108, and the reading device 1110; however, there is no limitation to this. For example, the computer system can be made of the computer 1102 and the printer 1106, or the computer system does not have to be provided with one of the display device 1104, the input device 1108, and the reading device 1110. It is also possible that the printer 1106 has some of the functions or mechanisms of the computer 1102, the display device 1104, the input device 1108, and the reading device 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

In the embodiment described above, it is also possible for the computer program for controlling the printer to be taken into the memory 65, which is a storage medium of the control unit 60. Also, the control unit 60 may execute the computer program stored in the memory 65 so as to achieve the operations of the printer in the embodiment described above.

As an overall system, the liquid ejecting system that is thus achieved is superior to conventional systems.

===Other Embodiments===

In the foregoing, a printing apparatus such as a printer according to the invention was described based on an embodiment thereof. However, the foregoing embodiment is for the purpose of elucidating the present invention and is not to be interpreted as limiting the present invention. The invention can of course be altered and improved without departing from the gist thereof and includes equivalents. In particular, the embodiments described below are also included in the liquid ejecting apparatus according to the present invention.

In this embodiment, some or all of the configurations achieved by hardware may be replaced by software, and conversely, some of the configurations that are achieved by software can be replaced by hardware.

Furthermore, in addition to print paper, the medium to be printed may be cloth or film for example.

It is possible to perform some of the processes that are performed on the liquid ejecting apparatus side on the host side instead, and it is also possible to provide a dedicated processing device between the liquid ejecting apparatus and the host and perform some of the processes using this processing apparatus.

<Regarding the Liquid Ejecting Apparatus>

The liquid ejecting apparatus of the present invention can be adopted for printing apparatuses such as an inkjet printer as described above, and in addition to these it also can be adopted for color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices, for example.

<Regarding the Liquid>

The liquid of the present invention is not limited to ink, such as dye ink or pigment ink, as described above, and it is also possible to adopt liquids (including water) including metallic material, organic material (particularly macromolecular material), magnetic material, conductive material, wiring material, film-formation material, electronic ink, machining liquid, and genetic solutions, for example. Moreover, as regards the constituents of the liquid, the liquid can also be made of solvents such as water and dissolving agents.

<Regarding the Medium>

As regards the medium, it is possible to use plain paper, matte paper, cut paper, glossy paper, roll paper, paper, photographic paper, and rolled photographic paper, for example, as the paper described above. In addition to these, it is also possible to use film material, such as OHP film or glossy film, cloth material, and sheet metal material, for example. In other words, any medium may be used, as long as liquid can be ejected onto it.

INDUSTRIAL APPLICABILITY

According to a principal feature of the present invention, it is possible to achieve a liquid ejecting apparatus, a liquid ejecting method, and a liquid ejecting system that are capable of reducing problems caused when a certain type of liquid, from among the plurality of types of liquids that are ejected from a liquid ejecting section, reaches a region that is outside a medium.

Furthermore, according to another principal feature of the present invention, it is possible to achieve a liquid ejecting apparatus that is capable of reducing problems caused when a certain type of liquid, from among the plurality of types of liquids that are ejected from a liquid ejecting section, reaches a region that is outside a medium.

The invention claimed is:

1. A liquid ejecting apparatus comprising:

a first liquid ejecting section that ejects a first liquid toward a medium;

a second liquid ejecting section that ejects a second liquid toward the medium; and a liquid recovery section that recovers liquid that has missed the medium, wherein an amount of the second liquid that remains in the liquid recovery section when a predetermined amount of the second liquid has been ejected is larger than an amount of the first liquid that remains in the liquid recovery section when the predetermined amount of the first liquid has been ejected, wherein an ejection amount of the first liquid that reaches a region that is outside the medium is not reduced as compared with an ejection amount of the first liquid corresponding to image data to be printed, wherein an ejection amount of the second liquid that reaches the region that is outside the medium is reduced as compared with an ejection amount of the second liquid corresponding to image data to be printed.

2. A liquid ejecting apparatus according to claim 1, wherein the ejection amount of the second liquid is reduced such that the ejection amount becomes zero.

3. A liquid ejecting apparatus according to claim 1, wherein the liquid recovery section is provided with an absorbing material for absorbing the liquid that has been recovered.

4. A liquid ejecting apparatus according to claim 1, wherein the first liquid comprises ink, and wherein the second liquid comprises ink.

5. A liquid ejecting apparatus comprising:

a first liquid ejecting section that ejects a first liquid toward a medium;

a second liquid ejecting section that ejects a second liquid toward the medium;

a liquid recovery section that recovers liquid that has missed the medium; and an ejection control section that controls ejection of the first liquid and the second liquid, wherein an amount of the second liquid that remains in the liquid recovery section when a predetermined amount of the second liquid has been ejected is larger than an amount of the first liquid that remains in the liquid recovery section when the predetermined amount of the first liquid has been ejected, wherein, when the liquid ejecting section attempts to eject liquid into a region that is determined to be outside the medium, the ejection control section:

does not prevent the first liquid from being ejected into the region that is determined to be outside the medium, as compared with an ejection amount of the first liquid corresponding to image data to be printed, and prevents the second liquid from being ejected into the region that is determined to be outside the medium, as compared with an ejection amount of the second liquid corresponding to image data to be printed.

6. A liquid ejecting method comprising:

not reducing an ejection amount of a first liquid that reaches a region that is outside a medium as compared with an ejection amount of the first liquid corresponding to image data to be printed, reducing an ejection amount of a second liquid that reaches the region that is outside the medium as compared with an ejection amount of the second liquid corresponding to image data to be printed, wherein an amount of the second liquid that remains in a liquid recovery section when a predetermined amount of the second liquid has been ejected is larger than an amount of the first liquid that remains in the liquid recovery section when the predetermined amount of the first liquid has been ejected.

7. A liquid ejecting system comprising:

a computer; and a liquid ejecting apparatus that is connectable to the computer, having;

a first liquid ejecting section that ejects a first liquid toward a medium;

a second liquid ejecting section that ejects a second liquid toward the medium; and a liquid recovery section that recovers liquid that has missed the medium, wherein an amount of the second liquid that remains in the liquid recovery section when a predetermined amount of the second liquid has been ejected is larger than an amount of the first liquid that remains in the liquid recovery section when the predetermined amount of the first liquid has been ejected, wherein an ejection amount of the first liquid that reaches a region that is outside the medium is not reduced as compared with an ejection amount of the first liquid corresponding to image data to be printed, wherein an ejection amount of the second liquid that reaches the region that is outside the medium is reduced as compared with an ejection amount of the second liquid corresponding to image data to be printed.

* * * * *